US011920338B2

(12) United States Patent
Jones

(10) Patent No.: US 11,920,338 B2
(45) Date of Patent: Mar. 5, 2024

(54) FEED PAD WATER COLLECTION SYSTEM AND METHOD

(71) Applicant: Michael Jones, Berlin, WI (US)

(72) Inventor: Michael Jones, Berlin, WI (US)

( * ) Notice: Subject to any disclaimer, the term of this patent is extended or adjusted under 35 U.S.C. 154(b) by 301 days.

(21) Appl. No.: 17/463,920

(22) Filed: Sep. 1, 2021

(65) Prior Publication Data

US 2022/0243449 A1 Aug. 4, 2022

Related U.S. Application Data

(60) Provisional application No. 63/145,677, filed on Feb. 4, 2021.

(51) Int. Cl.
*E03F 1/00* (2006.01)
*E03F 5/04* (2006.01)

(52) U.S. Cl.
CPC . *E03F 1/00* (2013.01); *E03F 5/04* (2013.01)

(58) Field of Classification Search
CPC ... E03F 1/00; E03F 1/002; E03F 1/003; E03F 1/005; E03F 5/04; E03F 5/0401
See application file for complete search history.

(56) References Cited

FOREIGN PATENT DOCUMENTS

| | | | | |
|---|---|---|---|---|
| BR | 102020013814 | A2 | * | 1/2022 |
| CN | 210674500 | U | * | 6/2020 |
| CN | 214835221 | U | * | 11/2021 |
| CN | 215166070 | U | * | 12/2021 |
| CN | 215166072 | U | * | 12/2021 |
| CN | 215166354 | U | * | 12/2021 |
| CN | 216551987 | U | * | 5/2022 |
| GB | 2492196 | A | * | 12/2012 |

OTHER PUBLICATIONS

Minnesota Pollution Control Agency, "Feed storage areas at animal feedlots", Oct. 2017 (Year: 2017).*
K-State Reasearch and Extension, "Leachage from Silage and Wet Feed Storage", Sep. 2020. (Year: 2020).*
Between the Lakes Demonstration Farm Network, "Keep Clean Water Clean with Feed Storage Area Design," https://www.facebook.com/BTLDemoFarms/videos/602813817510429/ Sep. 23, 2021. (Year: 2021).*

* cited by examiner

*Primary Examiner* — Frederick L Lagman
(74) *Attorney, Agent, or Firm* — Quarles & Brady LLP

(57) ABSTRACT

A feed storage arrangement for use with a sheet like feed barrier, the storage arrangement comprising at least one elongated leachate channel having an outlet end; and at least a first feed pad section extending along at least a portion of a length dimension of the leachate channel, the first pad section including first and second lateral edges and upper and lower edges wherein the first lateral edge is located proximate the leachate channel, the second edge is spaced apart from the first edge, the upper edge is proximate the outlet end of the leachate channel, and the lower edge is opposite and spaced from the upper edge, the first pad section sloped downward starting at the second edge and toward the first edge, wherein, with feed supported on the first pad section adjacent the leachate channel, the feed barrier is positionable on top of the feed with an edge portion extending over the leachate channel to a side of the leachate channel opposite the first pad section.

30 Claims, 11 Drawing Sheets

FEED PAD WATER COLLECTION SYSTEM AND METHOD

CROSS-REFERENCES TO RELATED APPLICATIONS

This application claims priority to U.S. provisional patent application No. 63/145,677 which was filed on Feb. 11, 2021 and which is titled "Feed Pad Water Collection System and Method" which is incorporated herein in its entirety by reference.

STATEMENT REGARDING FEDERALLY SPONSORED RESEARCH

Not applicable.

BACKGROUND

The field of the disclosure is feed pad storage areas and more specifically systems and methods of collecting clean water runoff and reducing leachate discharge (e.g., silage, haylage) from the feed pad storage area.

Typically, feed storage areas include large concrete slabs with piles of feed stored on the slabs. Rainwater that then hits the piles of feed, or the pad, is labeled as leachate. Previously, the leachate would runoff or be directed to a vegetated treatment area. Recently, the Department of Natural Resources and the Environmental Protection Agency have implemented that 100% of the rainwater (or snowmelt) that falls on a feed storage pad must be collected and treated as leachate. This rainwater is traditionally collected into a tank or a manure pit, which then must be pumped out. The costs associated with pumping out the tank can be upwards of $0.02/gal. Annually, even on a modest feed storage pad, that can cost upwards of $60,000. For large scale farms, the annual cost to the farmer can exceed $250,000.

Some feed storage areas include plastic to cover the piles of feed. However, as noted above, the rainwater that sheds off the plastic sheets must also be collected as it inevitably will come into contact with the feed to become leachate, or into contact with leachate sitting on the feed pad. For example, leachate leaks out from under the plastic cover, and is then able to mix with rainwater shedding off the top of the plastic cover. Further, as the feed piles are utilized, the rainwater on the concrete that remains must also be collected as it too will inevitably come into contact with the feed, or leachate on the feed pad.

What is needed is a simple and effective solution for preventing rainwater from coming in contact with the feed and becoming leachate.

BRIEF SUMMARY

Provided herein is a feed storage area configured to prevent rain water, snowmelt, and water runoff from becoming leachate. According to one aspect of the present disclosure, a feed storage area is provided. The feed storage area includes at least one feed pad configured to support a feed pile, at least one leachate channel arranged adjacent to the feed pad, a feed barrier configured to cover a feed pile on top of the feed pad. An edge of the feed barrier is configured to be positioned on top of the leachate channel and extend past the leachate channel on a side of the leachate channel opposite the feed pile.

In at least some cases embodiments include a feed storage arrangement for use with a sheet like feed barrier, the storage arrangement comprising at least one elongated leachate channel having an outlet end, and at least a first feed pad section extending along at least a portion of a length dimension of the leachate channel, the first pad section including first and second lateral edges and upper and lower edges wherein the first lateral edge is located proximate the leachate channel, the second edge is spaced apart from the first edge, the upper edge is proximate the outlet end of the leachate channel, and the lower edge is opposite and spaced from the upper edge, the first pad section sloped downward starting at the second edge and toward the first edge, wherein, with feed supported on the first pad section adjacent the leachate channel, the feed barrier is positionable on top of the feed with an edge portion extending over the leachate channel to a side of the leachate channel opposite the first pad section.

Some embodiments further include a clean water channel arranged on a side of the leachate channel opposite the first pad section, wherein the water channel is configured to receive water runoff from on top of the feed barrier. In some cases the slope from the second edge toward the first edge is at least ½ degree.

In some cases the slope of the first pad section between the second and first edges is substantially uniform. The feed storage arrangement of claim 2 further including a clean water drain near the first edge on a side of the leachate channel opposite the clean water channel, the drain opening downward and extending laterally past the leachate channel and into the clean water channel, the arrangement further including a solid drain cover removably positionable within the drain to close the drain and to be removed to open the drain. The feed storage arrangement of claim 5 further including a sloped portion between the leachate channel and the drain that is sloped downward from the leachate channel toward the drain.

In some cases the first pad section slopes from the lower edge toward the upper edge. In some cases wherein the drain is located adjacent the upper edge of the first pad section. Some embodiments further include at least a second pad section having first and second lateral edges and upper and lower edges wherein the first lateral edge of the second pad section is located proximate the leachate channel, the second edge of the second pad section is spaced apart from the first edge, the upper edge of the second pad section is proximate the lower edge of the first pad section and the lower edge of the second pad section is opposite and spaced from the upper edge of the second pad section, the second pad section sloped downward starting at the second edge of the second pad section and toward the first edge of the second pad section and sloped downward starting at the lower edge of the second pad section and toward the upper edge of the second pad section, the arrangement further including a second clean water drain proximate the leachate channel and the upper edge of the second pad section that opens downward and extends laterally past the leachate channel to open into the clean water channel, the arrangement further including a second solid drain cover removably positionable within the second drain opening to close the second drain and to be removed to open the second drain.

Some embodiments further include a sloped portion between the portion of the leachate channel adjacent the second pad section and the second drain that is sloped downward toward the second drain. Some embodiments further include a barrier between the first and second pad sections that inhibits liquid from passing from the second pad section to the first pad section. In some cases the barrier forms a surface that extends upward from the second pad section adjacent the upper edge of the second pad section. In some cases the first pad section extends from an upper edge of the surface formed by the barrier toward the upper edge of the first pad section. In some cases the pad and leachate channel are formed out of concrete.

In some cases the leachate channel is a first leachate channel, the arrangement further including a second leachate channel and a second feed pad section, the second leachate channel extending along the clean water channel on a side of the clean water channel opposite the first leachate channel, the second pad section including first and second lateral edges and upper and lower edges wherein the first lateral edge is located along the second leachate channel, the second edge is spaced apart from the first edge and forms a pad width dimension, the upper edge is near the outlet end of the second leachate channel, and the lower edge is opposite and spaced from the upper edge and forms a pad section length dimension of the second pad section, the second pad section sloped downward starting at the second edge of the second pad section and toward the first edge of the second pad section along at least a substantial portion of the width dimension of the second pad section.

The feed storage arrangement of claim 15 further including a first clean water drain near the first edge of the first pad section on a side of the first leachate channel opposite the clean water channel, the first drain opening downward and extending past the first leachate channel and into the clean water channel, the arrangement further including a first solid drain cover removably positionable within the drain to close the drain and to be removed to open the drain, the arrangement further including a second clean water drain near the first edge of the second pad section on a side of the second leachate channel opposite the clean water channel, the second drain opening downward and extending past the second leachate channel and into the clean water channel, the arrangement further including a second solid drain cover removably positionable within the drain to close the drain and to be removed to open the drain.

In some cases each of the first and second pad sections angles downward from the lower edge toward the upper edge of the pad section.

In some cases the feed pad includes a clean water drain that opens downward and extends laterally past the leachate channel and off the pad wherein all portions of the upper surface of the pad section angle toward the clean water drain.

Other embodiments include a feed storage arrangement for use with a sheet like feed barrier, the storage arrangement comprising at least one leachate channel having an opening and an outlet that leads to a leachate basin, a clean water drain that forms an upward opening and defines a passageway that has a clean water drain outlet, a feed pad section that forms an upper surface that is adjacent one side of the leachate channel, the upper surface formed about the upward opening of the clean water drain where the upward opening is proximate the leachate channel, the upper surface of the pad section sloped toward the upward opening so that water on all portions of the upper surface flows toward the upward opening and an impervious or solid cover positionable in the upward opening to close off that opening and removable from the upward opening to open the upward opening for water to pass from the pad surface through the passageway formed by the drain and out the drain outlet, wherein, with feed supported on the pad section adjacent the leachate channel, the feed barrier is positionable on top of the feed with an edge portion extending over the leachate channel to a side of the leachate channel opposite the first pad section.

Still other embodiments include a feed storage arrangement for use with a sheet like feed barrier, the storage arrangement comprising an elongated clean water channel that extends from a first end downward along a slope to an outlet end, a first elongated leachate channel extending a long a first side of the clean water channel from a first end downward along a slope to an outlet end, a first feed pad located along a side of the first leachate channel opposite the clean water channel, the first feed pad forming an upper surface that includes a first plurality of substantially rectangular pad sections wherein each pad section includes an upper edge, a lower edge and first and second lateral edges, with the first lateral edges located adjacent the first leachate channel, each pad section sloped downward from its lower edge toward its upper edge and sloped downward from its second lateral edge toward its first lateral edge, a separate incongruity between adjacent ones of the first plurality of pad sections that restricts liquid flow between pad sections on opposite sides of the incongruity, a separate clean water drain adjacent the upper edge and first lateral edge of each one of the pad sections in the first plurality of pad sections wherein each drain includes an upward opening and forms a passageway from the upward opening past the first leachate channel and into the clean water channel, an impervious cover receivable within and removable from the upward opening to close off the clean water drain when installed in the upward opening and open the clean water drain when removed from the upward opening, wherein, with feed supported on any set of the pad sections adjacent the leachate channel, the feed barrier is positionable on top of the feed with an edge portion extending over the leachate channel to a side of the leachate channel opposite the first pad section.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

Figure 1:
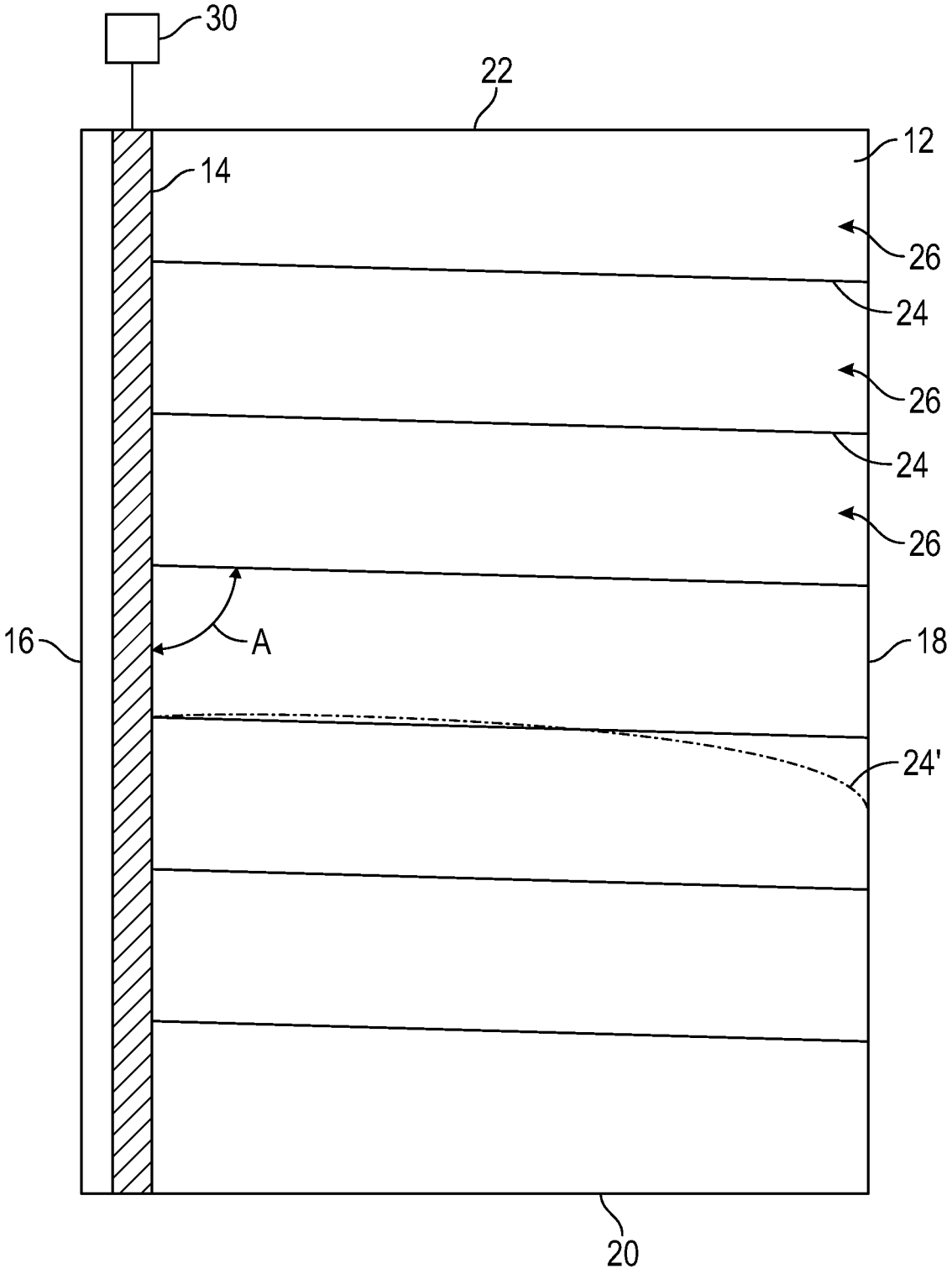
FIG. 1 illustrates an exemplary overhead view of a feed storage area according to one aspect of the present disclosure.

Before any aspect of the present disclosure are explained in detail, it is to be understood that the present disclosure is not limited in its application to the details of construction and the arrangement of components set forth in the following description or illustrated in the following drawings. The present disclosure is capable of other configurations and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use aspects of the present disclosure. Various modifications to the illustrated configurations will be readily apparent to those skilled in the art, and the generic principles herein can be applied to other configurations and applications without departing from aspects of the present disclosure. Thus, aspects of the present disclosure are not intended to be limited to configurations shown, but are to be accorded the widest scope consistent with the principles and features disclosed herein. The following detailed description is to be read with reference to the figures, in which like elements in different figures have like reference numerals. The figures, which are not necessarily to scale, depict selected configurations and are not intended to limit the scope of the present disclosure. In addition, some of the drawings may be simplified for clarity. Thus, the drawings may not depict all of the components of a given apparatus (e.g., device) or method. Skilled artisans will recognize the non-limiting examples provided herein have many useful alternatives and fall within the scope of the present disclosure.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

FIG. 1 illustrates an exemplary feed storage area 10. The feed storage area can include one or more feed pads 12 and at least one leachate channel or trench 14 or, in some cases, a leachate pipe or other mechanical structure that can form a passageway. The feed pad 12 can be configured to support a mass of feed (see FIGS. 2 and 3) placed on top of the feed pad 12. The feed pad 12 can be formed from a concrete slab, other masonry material, or some other structural material that will not rot when in contact with liquid over extended periods of time. The leachate channel 14 can be arranged adjacent to one of a first lateral edge 16 of the feed pad 12 or an opposing second lateral edge 18. According to some embodiments, the leachate channel 14 can be centrally arranged on the feed pad 12 as will be described in later embodiments. In the illustrated embodiment, the leachate channel 14 is arranged adjacent to the first lateral edge 16. The leachate channel 14 can extend from a first end 20 of the feed pad 12 to an opposing second end 22. The leachate channel may have a depth anywhere between 6 inches and three feet at a shallow end and in a particularly advantageous case the deep end depth is around 1½ feet. The bottom surface of the leachate channel in at least some cases slopes from the shallow end toward a deeper outlet end so that liquids or leachate therein tends to flow toward the outlet end under the force of gravity. According to some embodiments, the leachate channel 14 can include a covering arranged on top of the leachate channel 14. For example, a grating or grate member can be placed on top of the leachate channel 14. Where a grate member is provided, the grate member may be formed of steel and may form openings for allowing leachate to pass from a top surface of the pad to the leachate channel 14 there below. To this end, in some cases the grate member may form circular or elongated slot openings having dimensions that allow leachate to pass therethrough. In some embodiments the openings of slots will have a radial or width dimension between one quarter inch and ten inches and in other cases the dimension will be between one inch and two inches.

In some embodiments the feed pad 12 may define a grade in at least one direction. In the illustrated embodiment, the feed pad 12 is pitched towards the leachate channel 14. For example, the feed pad 12 can define a grade that is sloped from the second lateral edge 18 towards the first lateral edge 16 such that liquids on the top surface of the pad drain towards the first lateral edge 16. As will be described herein, the feed pad 12 can define a grade in multiple directions. For example, the feed pad 12 can define a first grade in a first direction (e.g., a lateral direction generally between edges 16 and 18) and a second grade in a second direction (e.g., a lengthwise direction between the first end 20 and the second end 22, or in other words, in a direction define by the leachate channel 14). In this case, in at least some embodiments the grades would angle toward leachate channel 14 and upper edge 22 as illustrated.

The feed storage area 10 can also include one or more pad barriers 24 configured to prevent leachate from leaking from one portion of the feed pad 12 to an adjacent portion of the feed pad 12 on an opposite side of the barrier 24. The pad barriers 24 can define a height between about 2 inches and about 15 inches. In a particularly preferred embodiment, the pad barriers can define a height between about 3 inches and about 6 inches. The pad barriers 24 can be substantially parallel to each other in some embodiments. In other embodiments the pad barriers may form slight acute angles so that all the barriers form angles within a 15 to 35 degree range of perpendicular to leachate channel 14. Each of the pad barriers 24 can be separated by a distance between about 35 ft to about 150 ft. In a particularly preferred embodiment, each of the pad barriers 24 can be separated by a distance between about 50 ft to about 100 ft.

In some cases pad barriers 24 may be substantially straight and in other embodiments the barriers may be curved (see curved barrier 24' in FIG. 1 shown in phantom) along at least a portion of their lengths. In some cases the barriers 24 may each be substantially perpendicular to leachate channel 14 and in other cases they may form acute angles with channel 14 as shown at angle A in FIG. 1.

Figure 9:
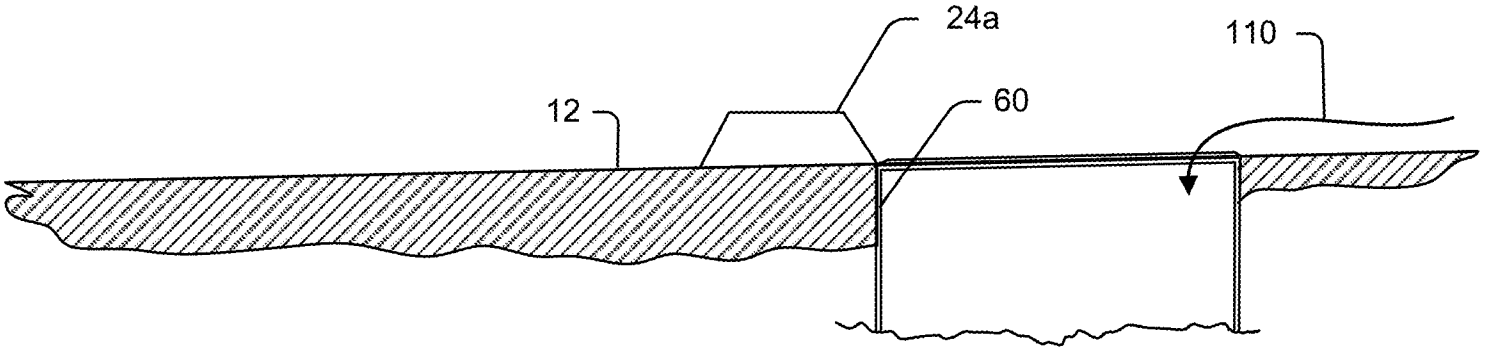
FIG. 9 is a partial cross section of a portion of a feed pad showing a barrier and a drain opening that is consistent with at least some aspects of some embodiments of the present disclosure.
Figure 10:
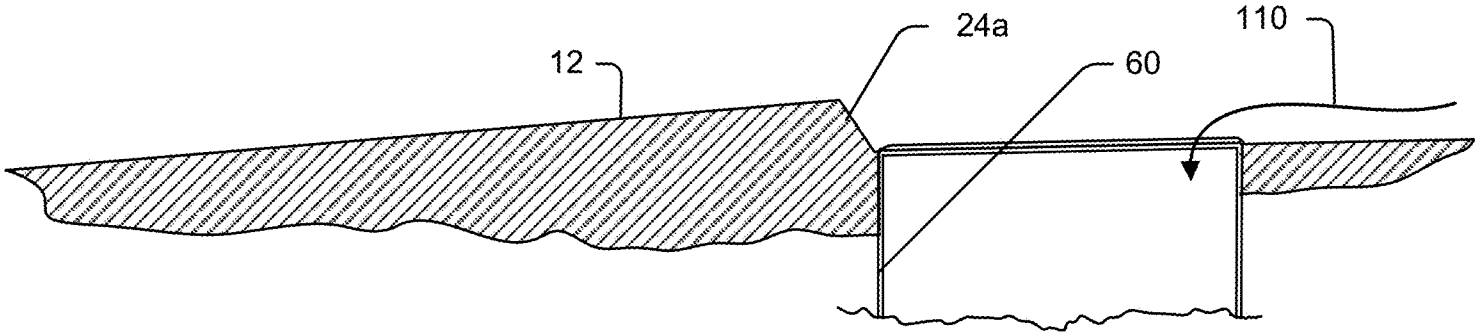
FIG. 10 is a partial cross section of a portion of a feed pad showing a barrier and a drain opening that is consistent with at least some aspects of some embodiments of the present disclosure.

The barriers 24 may have different cross sectional shapes. To this end, see for instance barrier 24*a* in FIG. 9 that has a trapezoidal shape that may be uniform along the entire length of the barrier. Other barrier cross sectional shapes may include square, generally triangular, etc. See also FIG. 10 where a barrier 24*b* is formed by a discontinuity or incongruity in a top surface of a concrete pad 12. In each of FIGS. 9 and 10 a top surface of the pad 12 is angled slightly downward from right to left and that slope or grade and its function will be described hereafter in greater detail. In general, the barrier forms surfaces that restrict or limit water or other liquid from passing between adjacent pad sections on opposite sides of the barrier. In addition, in each of FIGS. 9 and 10 a clean water drain 60 is also illustrated that is adjacent the barrier and that will be described in greater detail hereafter.

The pad barriers 24 can be movable or stationary. In the illustrated embodiment, the pad barriers 24 are stationary and can be integrally formed into the concrete of the feed pad 12, sort of like a roadway speed bump. In other cases a single moveable barrier 24 may be provided instead of the stationary barriers where the moveable barrier includes a mechanical subassembly that is moveable to be positioned at different locations on pad 12 to operate as a water/liquid barrier. For instance, in some cases a moveable barrier may include a rubber, somewhat flexible blocking member that that be manually moved via a front end loader or the like to traverse between pad edges 16 and 18 at different locations between ends 20 and 22 as needed. In some cases there may be more than one moveable barrier.

In the illustrated embodiment, the feed storage area 10 includes a plurality of pad barriers 24. The plurality of pad barriers 24 can divide the feed pad 12 into a plurality of feed pad sections 26 where each section has an upper edge, a lower edge opposite the upper edge, and first and second lateral edges that extend between the upper and lower edges. As will be described in further detail, the leachate channel 14 can be configured to collect leachate draining from the feed storage area 10 and divert the leachate to a leachate tank 30.

Figure 2:
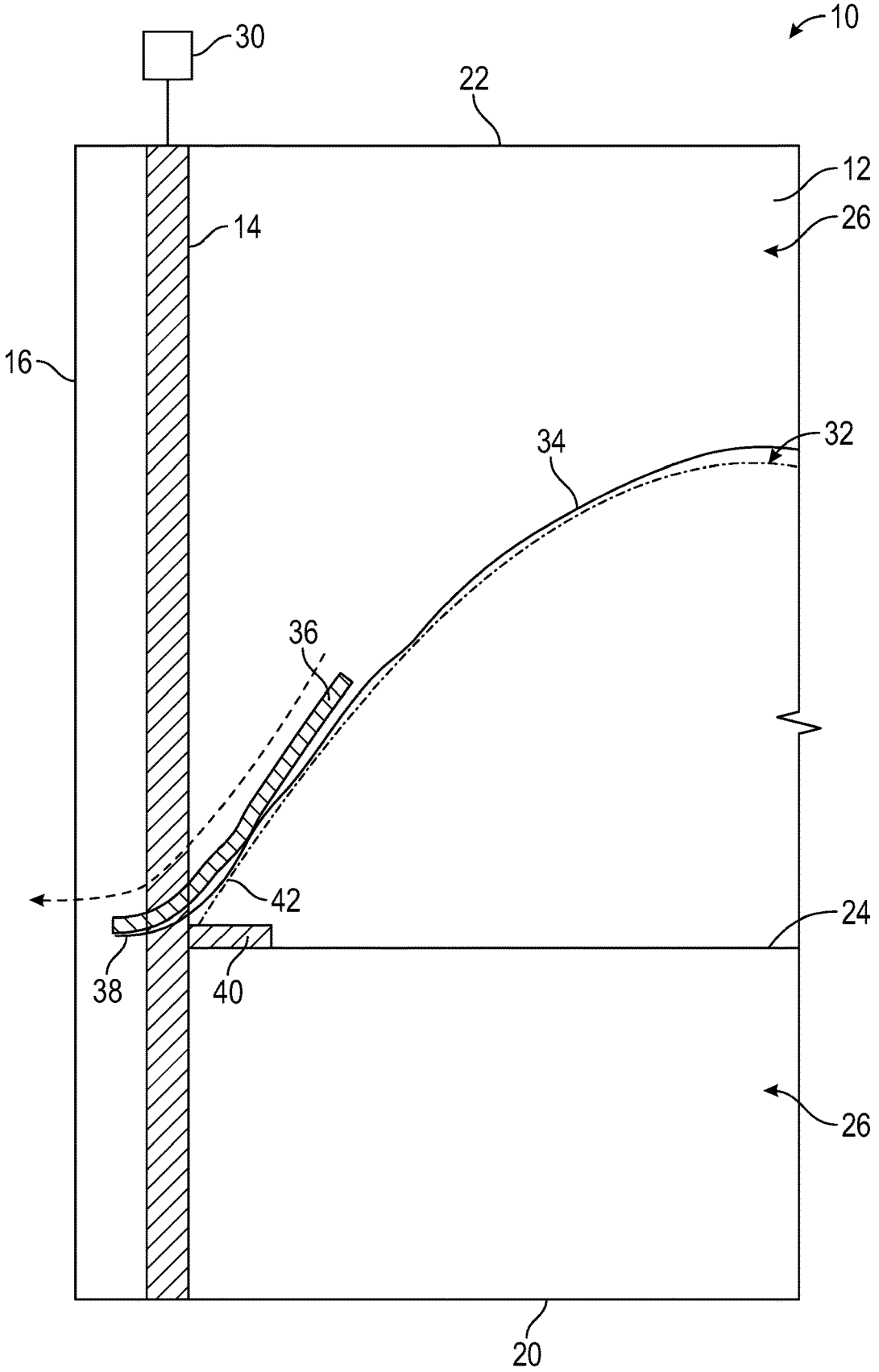
FIG. 2 illustrates an exemplary overhead view of the feed storage area of FIG. 1 with an cross-section of a feed pile overlaid onto the overhead view.

Turning now to FIG. 2, a feed pile 32 is schematically illustrated on top of the feed pad 12. In a real life example, the pile 32 would extend generally across the pad 12 from edge to edge (see again lateral edges 16 and 18 in FIG. 1) and from end 20 to end 22 initially. In FIG. 2 the pile 32 is shown to be thick in a middle section and to thin out near edge 16. In the illustrated embodiment, the feed pile 32 can abut or be within a few feet (e.g., 2-10) of the leachate channel 14. A feed barrier/cover 34 can be arranged on top of and configured to cover at least a portion of the feed pile 32.

According to some embodiments, the feed barrier 34 can be a plastic sheeting laid over the top of the feed pile 32. According to other embodiments, the feed barrier 34 can include multiple layers. For example, the feed barrier 34 can include a first layer (e.g., an oxygen barrier) and a second layer (e.g., a rain barrier). The first barrier can be a porous or breathable plastic layer. The second layer can be a non-porous waterproof plastic layer. According to some embodiments, the first layer and the second layer can define a different thickness. For example, the first layer can define a thickness that is less than the thickness of the second layer. According to some embodiments, weights (e.g., tires) can be placed on top of the feed barrier 34 to maintain the positioning of the feed barrier 34 relative to the feed pile 32.

The feed barrier 34 can be configured to prevent rainwater from getting into the feed pile 32 and prevent water 36 from running off into the leachate channel 14. In the illustrated embodiment, the feed barrier extends over the feed pile 32 and the leachate channel 14, thereby providing a barrier between the runoff water 36 and the leachate channel 14. The feed barrier 34 can include an edge 38, which can be configured to extend a distance past the leachate channel 14. According to some embodiments, the edge 38 of the feed barrier 34 can extend at least one foot past an edge of the leachate channel 14 that is opposite the feed pile 32. In other embodiments barrier 34 may extend 2 to 10 feet past the channel 14.

Referring still to FIG. 2, the leachate channel 14 and other arrangement structure can be configured to prevent leachate 40 from mixing with clean runoff water 36. In the illustrated embodiment, leachate 40 can build up along the bottom of the feed pile 32 and drain towards the leachate channel 14. The leachate 40 can then enter the leachate channel 14, which is covered by the feed barrier 34 (and a grate member in most cases), and be directed away from the feed pad 12 without passing to the clean water channel. The leachate 40 is thereby prevented from leaking or escaping from underneath the feed barrier 34 because the leachate channel 14 is arranged between the edge 38 of the feed barrier 34 and an edge 42 of the feed pile 32. Clean rain water that lands on top of the cover flows over the feed barrier 34, the grate, and the leachate channel 14, and runs off the feed pad 12 or is channeled away from the feed pad 12.

In the illustrated embodiment, the pad barriers 24 can also aid in control of the leachate 40. For example, the pad barriers 24 can guide the leachate 40 along the pad barriers 24 until the leachate 40 is drained into the leachate channel 14. Additionally, the pad barriers 24 can be configured to prevent leachate from one feed pad section 26 from entering an adjacent feed pad section 26. For example, as the feed pile 32 is being utilized from one end (e.g., 20) to the other (e.g., 22 in FIG. 1), feed pad sections 26 eventually become bare, and are considered clean feed pads. Rainwater that hits clean feed pad sections 26 is prevented from becoming leachate by the pad barriers 24 as the barriers prevent the rainwater from flowing to adjacent feed pad sections 26 that the feed pile still covers. As will be described below, the rainwater from the clean feed pad sections 26 is guided or directed off of the feed pad 12 for collection or dispersion.

Figure 3:
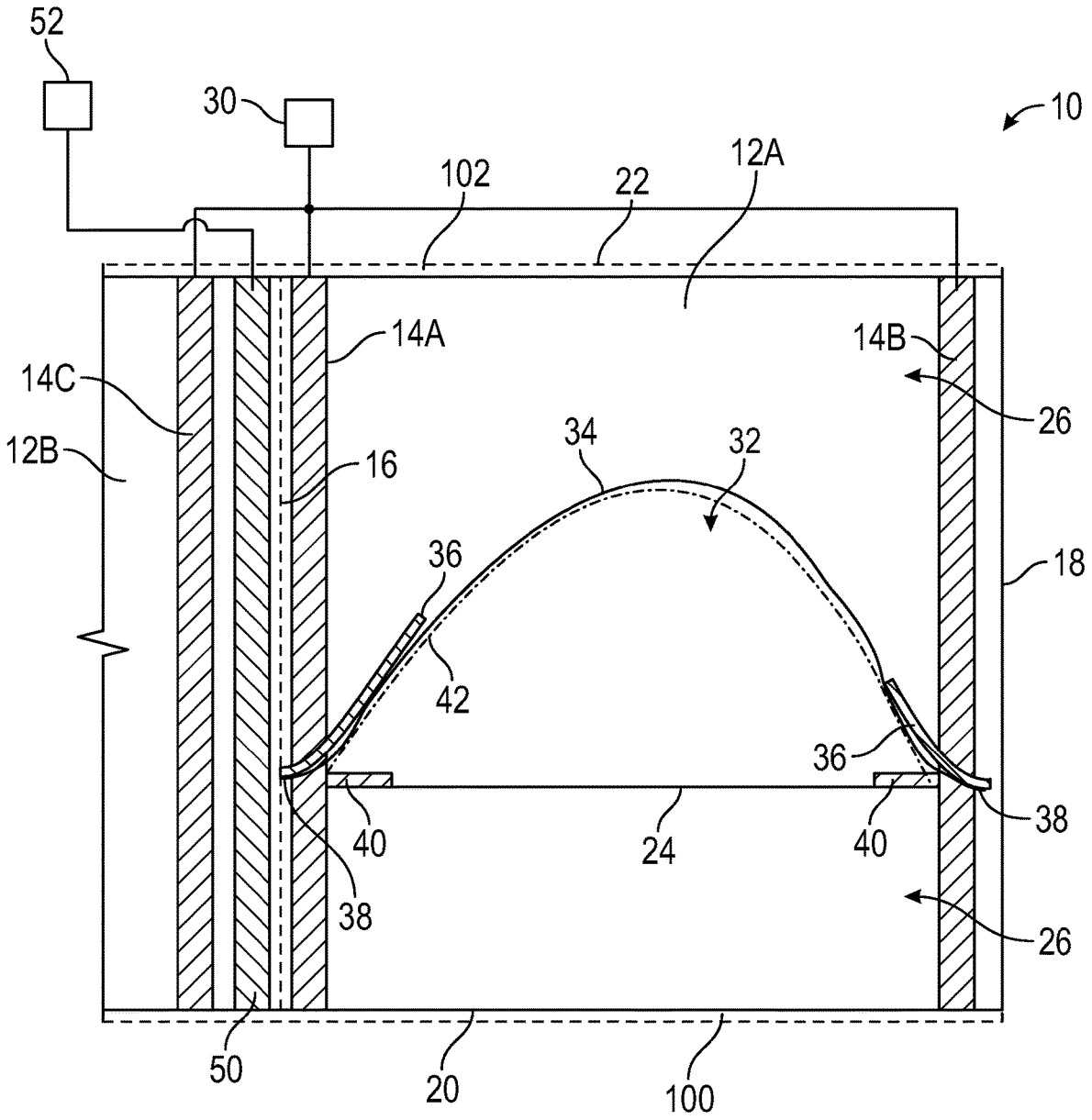
FIG. 3 illustrates an exemplary overhead view of a second embodiment of a feed storage area with an cross-section of a feed pile overlaid onto the overhead view.

Referring now to FIG. 3, the feed storage area 10 can include a clean water channel 50 configured to collect clean water that runs off from either one or both of the feed pile 32 and/or the feed pad 12. In the FIG. 3 embodiment, water channel 50 is arranged on a side of leachate channel 14 that is opposite feed pile 32. The edge 38 of the feed barrier 34 covers leachate channel 14 and leads into water channel 50, thereby capturing and collecting the clean water runoff from the feed barrier 34, preventing clean water 36 from entering leachate channel 14. Water channel 50 can then be discharged to a water tank 52 to be utilized elsewhere on a farm. According to another embodiment, the water channel 50 can be discharged or directed onto a ground surface or into a clean water basin outside of the feed storage area 10 (e.g., a ditch or runoff area). In at least some cases the clean water channel slopes downward from a first end to an outlet end so that water therein flows toward the outlet end. While shown as a channel, the clean water channel may include a pipe or other mechanical structure that forms a clean water passageway.

As illustrated in FIG. 3, the feed storage area 10 can include multiple feed pads 12. In FIG. 3, feed storage area 10 includes a first feed pad 12A and a second feed pad 12B. Water channel 50 is arranged between the first and second feed pads 12A, 12B. In the illustrated embodiment, a leachate channel 14 is arranged on each side of clean water channel 50. Each feed storage area 10 can include multiple leachate channels 14. In the illustrated embodiment, a first leachate channel 14A can be arranged adjacent to the first lateral edge 16 of the feed pad 12A and a second leachate channel 14B can be arranged on the second lateral edge 18 of the feed pad 12A. The leachate channels 14A-14C can be commonly connected to one leachate tank 30 or leachate runoff basin via a series of pipes or conduit. According to some embodiments, the leachate channels 14A-14C may be diverted to separate leachate tanks.

Figure 4:
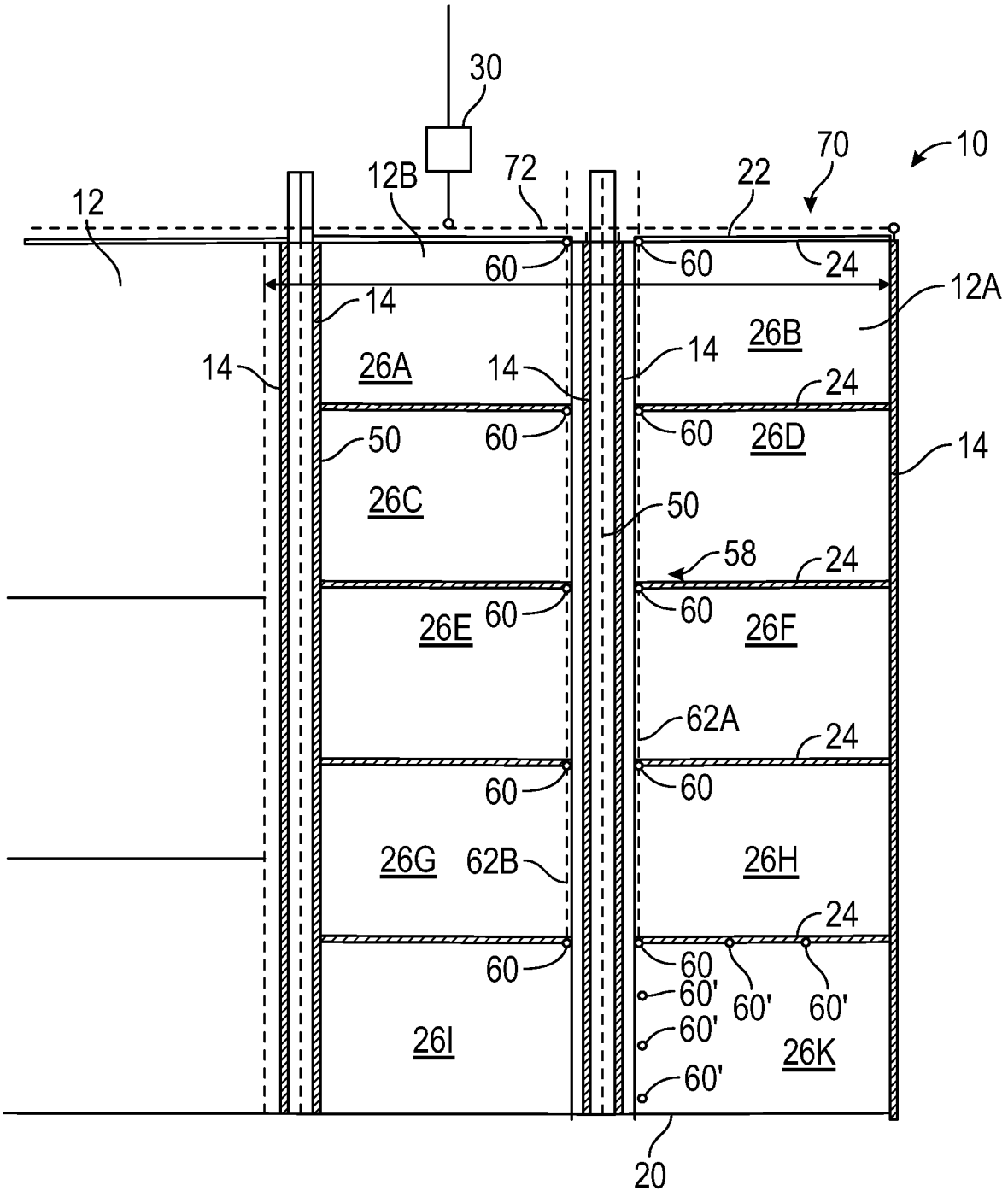
FIG. 4 illustrates an exemplary overhead view of a third embodiment of a feed storage area.

Turning to FIG. 4, another embodiment of a feed storage area 10 is illustrated. In the illustrated embodiment, the feed storage area includes a plurality of feed pads 12. The feed pads 12 combining to include a plurality of feed pad sections 26A-26K. In the illustrated embodiment, each of the plurality of feed pad sections 26A-26K includes a clean water drain 60. The water drain 60 can include a manhole with a solid (e.g., no holes) manhole cover where the manhole extends downward and into a clean water pipe arrangement 62A, 62B that forms clean water passageways. In at least some embodiments each water drain 60 is located at the lowest portion of an associated feed pad section 26 (e.g., all portions of the pad section slope toward the drain 60). In the illustrated embodiment, the water drains 60 are arranged adjacent pad barriers 24 and adjacent or at least proximate leachate channel 14 opposite water channel 50. When arranged in this manner, clean water that contacts a clean pad section 26 runs toward channel 14 and a section defining barrier 24 and generally toward the manhole 60. A water drain 60 is closed when a feed pile (not shown) is covering at least a portion of the feed pad section 26 corresponding to the specific water drain 60.

After the feed pile has been removed and a feed pad section 26 is clear, the associated water drain 60 is opened (e.g., by removing a manhole cover or by installing a grate) so that rainwater that contacts the clean pad section 26 drains into the water drain 60 and is directed off of the feed storage area 10 without reaching the leachate channel 14. For instance, when the feed pile covers at least a portion of a pad section 26, a solid, impervious manhole cover may cover and seal off a manhole associated with that section so that leachate generated above that pad section can run over the cover and into the leachate channel 14. Then, once the pad section is clean, the impervious or solid manhole cover can be removed and replaced with a grate type cover so that clean water on the pad section can be captured and does not reach the leachate channel 14.

Figure 5:
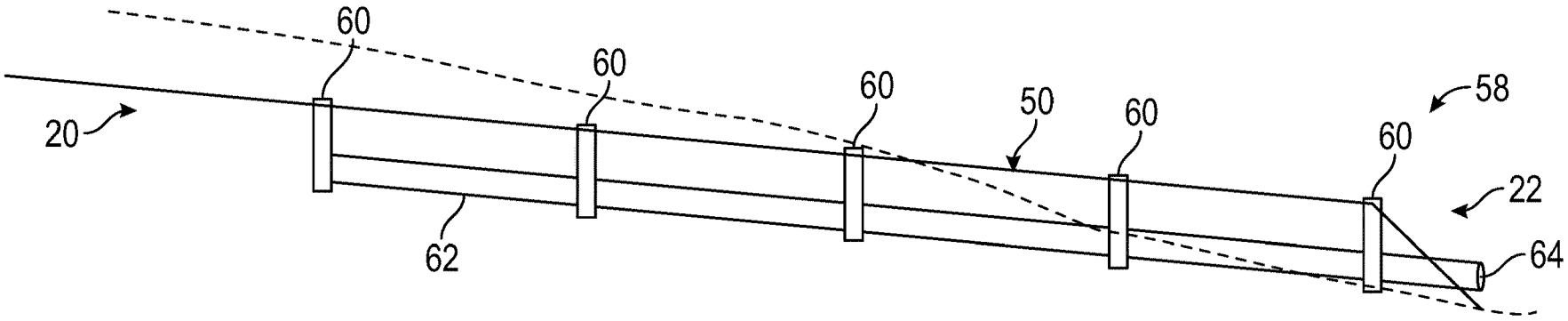
FIG. 5 illustrates a cross-sectional view of an underground water collection system of the feed storage area of FIG. 4.

As will be described in greater detail below, water drains 60 are constructed to drain into an underground water collection system 58 which directs the water drained from the feed pad sections 26 off feed storage area 10 (see FIG. 5). In the illustrated embodiment, each of the water drains 60 on the first feed pad 12A can be in fluid communication with each other via a water collection pipe 62A. Similarly, each of the water drains 60 arranged on the second feed pad 12B can be in fluid communication with each other via a water collection pipe 62B. In at least some embodiments the pipes 62A and 62B may be connected to each other underground. In still other embodiments all of the drains 60 may drain into a single drain pipe (e.g., 62A) to avoid having to run multiple clean water drain pipes. In still other embodiments drains 60 may lead into a bottom of the central clean water channel 50 to avoid having to have any pipe arrangements extend the length of the pad.

The feed storage area 10 can also include a leachate collection system 70. In the illustrated embodiment, each of the leachate channels 14 can be in fluid communication with a leachate collection pipe 72. The leachate collection pipe 72 can be configured to direct leachate flowing from the leachate channels 14 into a common pipe, outflow, or drain in fluid communication with the leachate tank 30 (see FIG. 6). According to some embodiments, a pump can be arranged between the leachate tank 30 and the leachate collection pipe 72 to pump the leachate away from the feed storage area 10. This can be particularly helpful if the feed pad 12, or the leachate collection pipes 72, are not graded sufficiently enough to allow gravity to assist with the draining.

Referring again to FIG. 5, an exemplary underground water collection system 58 with a water collection pipe 62 fed by a plurality of water drains 60 that is consistent with at least some aspects of the present disclosure is illustrated. In the illustrated embodiment, the water collection pipe 62 can define a grade that is configured to allow the water to flow from first end 20 of feed pad 12 towards second end 22. According to some embodiments, the water collection pipe 62 can define a grade between about 0.5% to about 8%. In a particularly preferred embodiment, the water collection pipe 62 can define a grade between about 1% to about 2%. In the illustrated embodiment, the water collection pipe 62 can define a grade that is parallel to a grade of the water channel 50. The water flowing through the water collection pipe 62 can then flow through a water outlet 64 at a distal end thereof. According to some embodiments, the water collection pipes (e.g., 62A and 62B, see FIG. 4) can be a common water pipe arranged directly below the water channel 50. In such an embodiment, each of the plurality of water drains 60 can be in fluid communication with the central water collection pipe. According to some embodiments, a pump can be arranged between the water outlet 64 and the water collection pipe 62 to pump water away from the feed storage area 10. This can be particularly helpful if the feed pad 12, or the water collection pipes 62, are not angled enough to allow gravity to result in complete draining.

Figure 6:
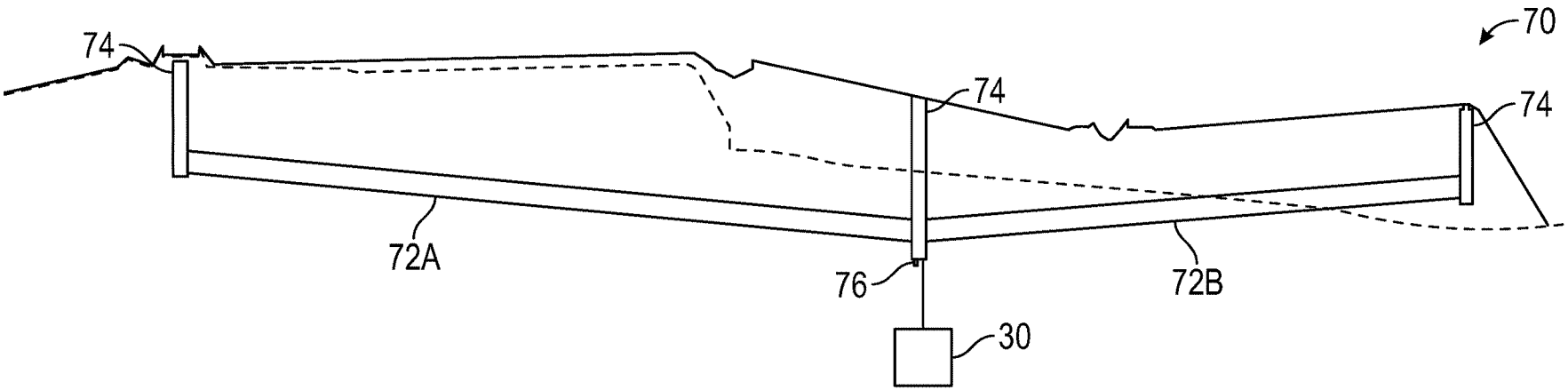
FIG. 6 illustrates a cross-sectional view of an underground leachate collection system of the feed storage area of FIG. 4.

Referring to FIG. 6, the underground leachate collection system 70 with a leachate collection pipe 72 is illustrated. The leachate collection pipe 72 can be fed by a plurality of leachate drains 74. The leachate drains 74 can be in fluid communication with the leachate channels 14 (see FIG. 4). In the illustrated embodiment, the leachate pipe can be manufactured from PVC, concrete, steel, etc. The leachate collection pipe can define a diameter between about 10 inches and about 20 inches. In the illustrated embodiment, the leachate collection pipe 72 can include a first leachate collection pipe 72A and a second leachate collection pipe 72B. The first and second leachate collection pipes 72A and 72B can be directed towards a central leachate drain 76, which can then be in fluid communication with the leachate tank 30. According to some embodiments, the leachate collection pipe 72 can define a grade between about 0.5% and about 8%. In a particularly preferred embodiment, the leachate collection pipe 72 can define a grade between about 1% to about 2%.

Figure 7:
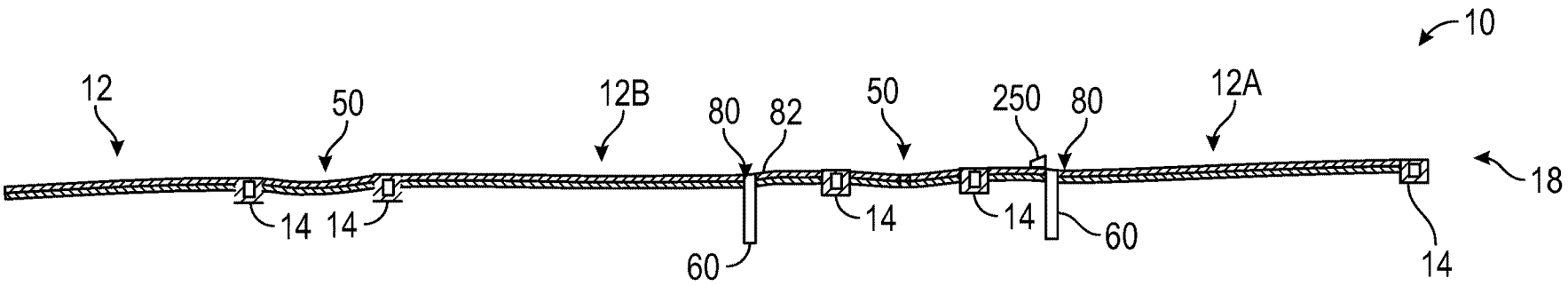
FIG. 7 illustrates a cross-sectional view of the feed storage area of FIG. 4.

Referring now to FIG. 7, a cross section of the feed storage area 10 is illustrated. In the illustrated embodiment, the first and second feed pads 12A, 12B can each define a first grade in a direction toward the central clean water channel 50. According to some embodiments, the grade toward channel 50 can be between about 0.5% and about 8%. In a particularly preferred embodiment, the grade in the first direction can be between about 1% to about 2%. In the illustrated embodiment, the feed pad 12 can include a drain trench 80 arranged just above water drain 60 and that extends between feed pad 12 and an adjacent leachate channel 14. The drain trench 80 can be formed by the grade of the feed pad 12 (e.g., 2%) abutting a sloped portion 82 of an opposing grade. The sloped portion 82 can define a grade between about 1% and about 20% and have a width dimension (shown in cross section in FIG. 7) that is between 1 and 15 feet. In at least some embodiments, the width dimension can be between 2 and 10 feet. In a particularly preferred embodiment, the sloped portion 82 can define a grade between about 10% to about 18%. Here, water that runs down pad 12B toward leachate channel 14 is pools up in the trench 80 above drain 60 so that when an apertured cover is placed over the drain 60, the pooled water passes therethrough and into the clean water drain arrangement.

In the illustrated embodiment, the clean water channel 50 may define a v-shaped trench, a U-shaped trench, or some other trench shape. The clean water channel can be defined by opposing sloped surfaces, where each of the sloped surfaces can define a grade between about 0.5% and about 20%. In a particularly preferred embodiment, the each of the opposing sloped surfaces can define a grade between about 10% to about 20%. In at least some embodiments each of the sloped surfaces that together form the channel 50 will have a width dimension between 2 and 15 feet and, in particularly advantageous cases, the width will be between 3 and 10 feet so that the distance between adjacent edges of two leachate channels 14 will be between approximately 2 and 20 feet. In some cases the clean water channel may be 6 inches deep, one foot deep, three feet deep, etc. In some cases the clean water channel will be graded from lower end 22 in FIG. 1 to upper end 20 within a range of between 0.5 and 8% and in particularly advantageous embodiments that grade will be within 1 and 4 degrees.

Figure 8:
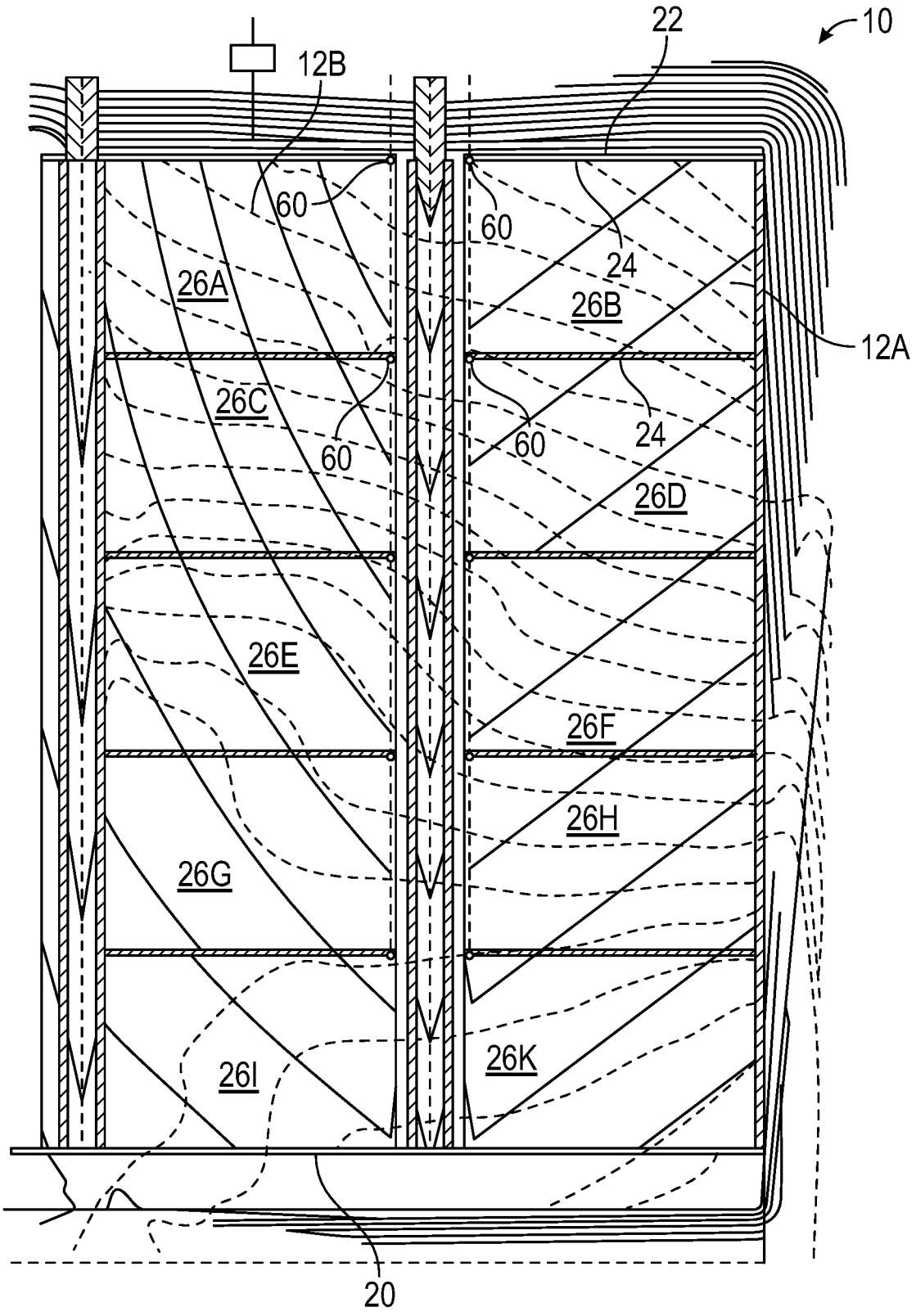
FIG. 8 illustrates a topographical overhead view of the feed storage area of FIG. 4.

Referring now to FIG. 8, a topographical overhead view of another feed storage area 10 is illustrated. In FIG. 8, each of the feed pads 12A, 12B can define a first grade in a first direction (e.g., a lateral direction) as described above with respect to FIG. 7. The feed pads 12A, 12B can also define a second grade in a second direction (e.g., a lengthwise direction between the first end 20 and the second end 22, or in other words). According to some embodiments, the grade in the second direction can be between about 0.5% and about 8%. In a particularly preferred embodiment, the grade in the second direction can be between about 0.5% to about 8%. In the illustrated embodiment, each of the plurality of feed pad sections 26A-26K can define a grade in both the first direction and the second direction. For example, as illustrated in FIG. 8, each of the plurality of feed pad sections 26 can define a grade configured to be substantially directed at the water drain 60.

An example of how an exemplary feed pad is used is instructive. To this end, an example will be described in the context of FIG. 4. Initially, in FIG. 8, impervious manhole covers are placed on and seal up all of the drains 60 (e.g., seal a separate drain 60 for each of the barriers 24. Next, first and second feed piles are dumped onto pads 12A and 12B, respectively, to substantially cover each pad between lateral edges and the upper and lower ends. Here, each pile may be within one or a few feet of lateral, upper and lower edges of an associated pad 12A or 12B. Next, a feed cover or barrier 34 is placed over each of the piles with lateral edges of the cover passing over the leachate channels 14 and stopping short of the central clean water channel 50. At this point, any rain that hits the barrier 34 is directed laterally and over the leachate channels to the clean water channel 50 and out to a field or collected for utilization elsewhere.

When a famer needs feed, the farmer may start at the bottom end of one of the piles 32, peel back the barrier 34 to expose the face of the pile, and then use a frontend loader to pick up feed to deliver to livestock. Here, once a part of the barrier 34 is peeled back, some rain water that hits an exposed portion of a pad section 26 adjacent the feed face and that contacts the feed generates leachate which, based on the angled surfaces of the pad, flows under the force of gravity toward a lateral leachate channel 14 where the leachate is captured and delivered to a holding tank for processing.

Eventually an entire pad section 26 is exposed and "clean". At this point, the farmer can remove a manhole cover from the drain 60 associated with the clean pad section 26 and, in some cases, replace it with an apertured manhole cover to allow drainage therethrough. Now, feed is taken off a face of the pile over the next pad section on the opposite side of a barrier 24. At this point any rain or other liquid that lands on the clean pad section flows under gravitational force, down slope, toward the apertured cover/drain 60 (see also FIGS. 9, and 10 where water is represented by arrow 110). The trench 80 and sloped section 82 (see again FIG. 7) operate to restrict the water near the inner end of the barrier and effectively block it from entering the leachate channel 14 so that it pools at and then passes down into drain 60 and the piping there below.

As additional pad sections 26 are cleared and rendered "clean", the trench, barrier 24 and drain 60 associated with each newly cleared section operate to collect and direct rain water on that section to the clean water piping.

Thus, the feed barrier 34 operates to direct rain water to the clean water channel 50 prior to removal of feed thereunder. Other configuration components operate to direct rain water that contacts clean pad sections to clean water piping. Any rain water that contacts feed or a pad section that includes feed is directed to the leachate channel 14 to be processed according to regulatory requirements.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein. As another example, in at least some cases other structure may be provided that cooperates with the arrangements described above to direct water in optimal ways. For instance, in at least some cases concrete or other mechanical wall structures may be provided along ends of the feed pads to restrict any leachate from flowing off those ends. To this end, see the exemplary walls at 100 and 102 along pad ends 20 and 22 shown in phantom in FIG. 3. Here, each wall 100 and 102 may be anywhere in a range of 6 inches to four feet high to restrict leachate flow off the pad ends.

As another example, while the embodiments described above include one drain per pad section 26, in other embodiments there may be two or more drains per pad section. For instance, in some cases there may be four drains 60 per pad section that are spaced along the edge of the leachate channel 14. In other cases there may be two, three, four, etc., drains 60 that are spaced along an edge of each of the barriers 24. In this regard see exemplary drains 60' shown on pad section 26K in FIG. 4.

As another example, while the embodiments described above include one or more pad barriers 24, in other embodiments there may be no pad barriers. For instance, in some cases the feed pad 12 can be graded in such a way that the central portions of each feed pad section 26 is a "low point" and each of the areas where there are barriers 24 in the previous embodiments would instead be a "high point," resulting in a grade that alternates between high and low as you travel from one end 20 to the other end 22. In such an embodiment, as previously described herein, the feed pad may be graded such that water is directed towards a drain 60, 60'. For example, a lateral edge 14 along with the area between pad section (denoted at 24) can be a "high point" and the pad can be graded from that high point to one or more of the drains 60, 60'. In that way, the feed pad 12 may be graded such that no physical pad barriers 24 separate the pad section 26. Instead, the grading of the feed pad can define the pad sections.

While the embodiments described above are described as being used from one end toward the other, in at least some cases it is contemplated that a pad may be alternately used in different directions. For instance, in FIG. 4, feed may first be removed from pad 12A from lower end 20 toward upper end 22 and then, once upper pad section 26B is only partially covered with feed, more feed may be added to pad 26B and to cover pads 26D, 26F, 26H and 26K. At this point, a farmer may work in the opposite direction from upper end 22 toward lower end 20 to use up the older feed in the pile prior to using the newer feed.

While feed may be alternately used in opposite directions in some cases, in other cases feed may only be used in one direction (e.g., bottom end 20 to top end 22 in FIG. 4 or in the opposite direction). In these different cases the pad surface slopes relative to the feed pile are oppositely arranged. For instance, referring again to FIG. 4, on one hand, when a farmer works from lower end 20 toward upper end 22, the pad section slopes are always toward the feed pile. On the other hand, when the farmer works in from upper end 22 toward lower end 20, the pad section slopes are always away from the feed pile. When the surface slopes toward the feed pile, rain water landing on a pad section that is still partially covered by the pile runs toward the pile which can cause a greater amount of leachate as the water works its way through the pile and to the leachate drain. When the surface slopes away from the feed pile, rainwater landing on the pad section that is still partially covered by the pile runs away from the pile and therefore generates less dense leachate which may be advantageous in at least some cases.

In still other embodiments it is contemplated that the leachate channels may be replaced by leachate pipes or other covered channel structures where drains along pad edges open into the leachate pipes and are covered once pad sections are cleared so that clean water on clean pad sections then passes over the drain covers into a single clean water channel. To this end, see for instance FIG. 11 that shows a top plan view of another pad arrangement 150 that includes first and second feed pads 12A and 12B, a single clear water channel 50 and a single leachate pipe 152 shown in phantom. Clean water channel 50 again is located between the two pads 12A and 12B. Here, on the pad 12B side of the arrangement, the leachate pipe 152 is below grade and runs along one side of channel 50, generally between pad 12A and channel 50 and along most of the pad length between ends 20 and 22. Flow barriers 24 are provided that separate pad sections as above. In addition, another barrier or wall member 156 is provided that extends between pad ends 20 and 22 where wall member 156 forms openings 160 adjacent each of the inside ends of the flow barriers 24 for passing water from the pad to clean water channel 50. Elongated drains 170 are provided that extend across each of the openings where each drain 170 opens into the leachate pipe 152 there below. In at least some embodiments each pad section is graded or sloped toward an associated drain 170. The 12A pad side of the arrangement is similar to the 12B side except that there is no leachate pine 152 on that side. Instead, drain feed pipes 172 extend from each of the drains 174 on the 12A side under the clean water channel 50 to the leachate pipe 152 as also shown in phantom. Separate elongated sealing covers 180 (only one shown) are provided, one for each of the drains 170 and 174 that, when installed, seal off the drain so that water passes over the cover and the leachate pine into the fresh water channel 50.

In operation, with all of the drains 170 and 174 open (e.g., uncovered), a feed pile covering all the pad sections and spaced from the drains 170 and 174 and a feed barrier (e.g., akin to 34 described above) over the pile and extending over the drain openings, rain water falling on the feed barrier runs off as clean water into the clean water channel 50. At this point, any water that hits the feed pile runs toward one of the drains and enters the leachate pipe 152 as leachate. Assuming a farmer works the pile from the lower end 20 toward the upper end 22, eventually the lower pad section 26K is cleaned off up to the first lateral barrier 24. At this point, the farmer can install cover 180 over the drain 170 associated with pad section 26K and continue to take feed off the pile within the next pad section. Here, with cover 180 installed, rain water that contacts clean pad section 26K flows toward the opening 160 in the central wall 156 and therethrough toward and into the clean water channel 50. The farmer continues in this case to work the pile cleaning off pad sections and installing covers 180 in each drain corresponding to a clean section until the pile is gone.

When the farmer works the pile on pad 12A, the process is similar from the farmer's perspective. The only operational difference in the case of pad 12A is that leachate passing through drains 174 pass through the feed pipes 172, under the clean water channel 50 and into the leachate drain pipe 152. While not shown in the FIG. 11 embodiment it should be appreciated that other pad surface undulations and flow grades akin to those described above may be included in the FIG. 11 embodiment. Thus, for instance, there may be slightly angled pad surfaces near the drains 170, 174 to help pool water in those areas. In addition, where a wall or barrier is provided for flow directing, instead of a wall of upright member, those members or walls may be replaced by graded angled surfaces that accomplish similar function. In many cases a wall or vertically upright barrier is preferred as its flow directing function can often be accomplished with less overall pad area.

Figure 11:
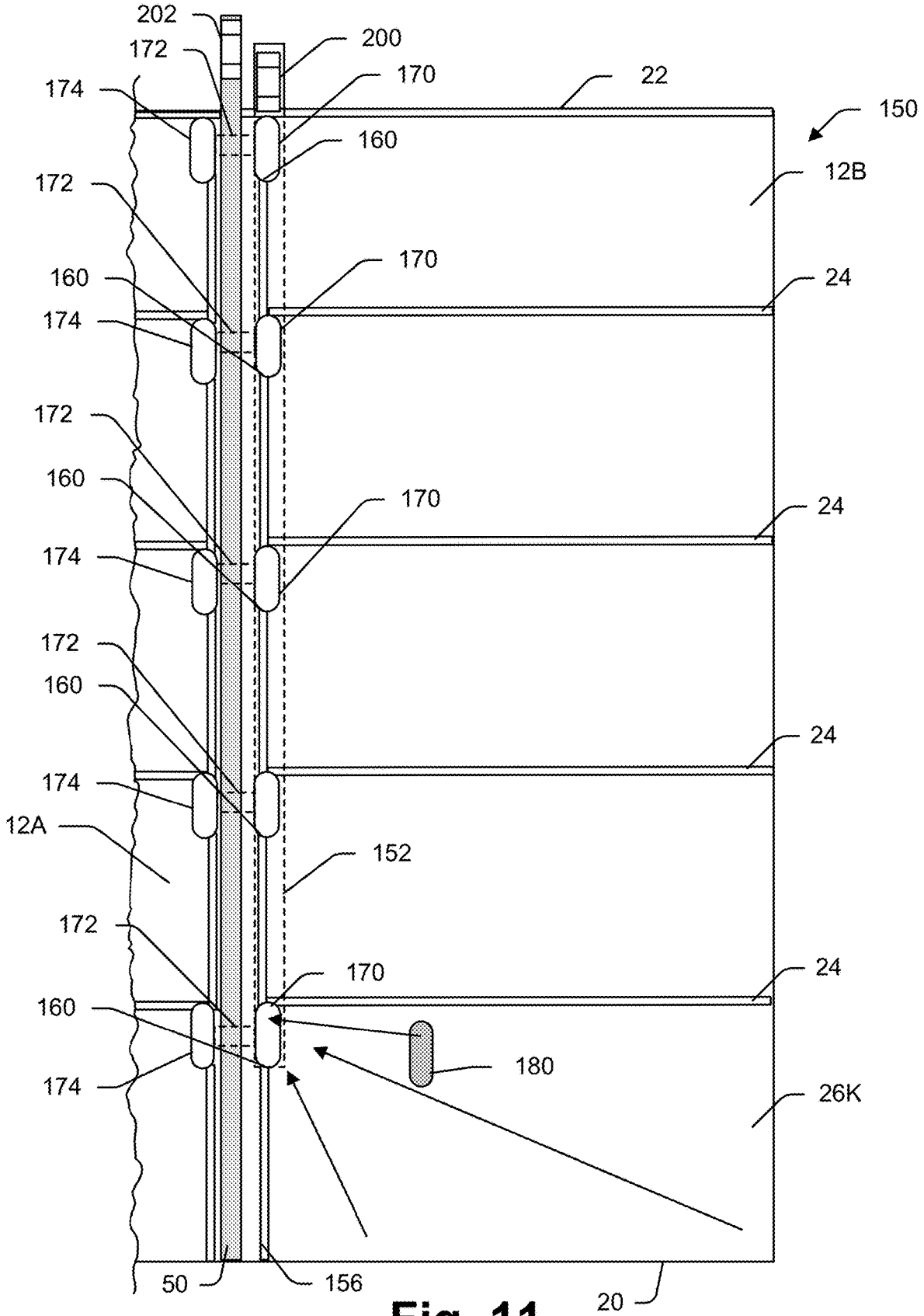
FIG. 11 is a top plan view of another pad arrangement that includes a single clean water channel and a single leachate drainage pipe that is consistent with at least some aspects of the present disclosure.

One advantage of the FIG. 11 embodiment is that only one clean water channel or pipe and one leachate pipe is required instead of several as in the prior embodiments.

In some of the embodiments above, the arrangements include channels and some include pipes for passing leachate and/or clean water. Here, the term "channel" generally means an open top passageway while the term "pipe" would include a member that has a continuous top and bottom structure. In cases where an embodiment is described as having a channel, unless indicated otherwise, the channel may be replaced with a pipe where there are drains that open into the pipe to receive flowing liquid. In cases described as including a pipe, unless indicated otherwise, those pipes may be replaced via channels that are open at the upper end. The term "conduit" will be used in this specification and the claims to refer to either a channel or a pipe in a general sense.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

In some cases it is contemplated that a leachate pipe or channel may become clogged with debris and in that case leachate could back up out of the channel and enter the clean water channel (see again 50 in FIG. 11). In this case, the leachate would contaminate the clean water channel and the clean water dumped on a nearby field which would be problematic. To deal with possible blockage conditions, in at least some cases it is contemplated that a grinder subassembly may be placed within the leachate flow path through the leachate channel or pipe which can be used to pulverize or grind leachate within the channel or pipe thereby enabling better flow within that pathway. For instance, in FIG. 11 an exemplary grinder assembly is shown at 200. Here, the grinder assembly may resemble a large garbage disposal unit conventionally positioned within a sink drain where the disposal unit can be turned on to grind up debris and matter trapped within the drain. In some cases the grinder assembly may be turned on periodically (e.g., every 4 hours) for a few minutes to ensure a "clean" leachate pathway. In other cases a rain sensor or channel water level sensor may be used to trigger grinder assembly operation based on when rain occurs or when specific volumes of rain occur. In other cases it is contemplated that the pump 30 (see again FIG. 3) associated with the leachate channel 14A, 14C may be periodically run in reverse for short durations either routinely or as triggered by a rain sensor or a leachate level sensor within the leachate channel, in a way designed to eliminate blockage within the channel thereby facilitating leachate movement.

While the clean water channel or pipe typically carries relatively clean water. In some cases some debris can wash into or blow into that channel or pipe and can cause blockage which would result in clean water backing up and entering the leachate channel(s) or pipe. For this reason, in at least some embodiments a separate grinding assembly 202 (see again FIG. 11) may be provided within the clean water channel 50 for grinding up and passing matter that is collected therein. The grinding assembly 202 may be turned on periodically or based on a rain start or volume trigger detected by a precipitation sensor or a sensor that detects the level of water within the clean water channel.

To be clear, instead of providing permanent barriers 24 of some type, in some cases moveable barriers 24 may be used to separate clean and unclean portions of the feed pad. In this case, as a feed pile is worked back, that moveable barrier can be moved along the clean pad portion leaving only a minimal width space between the barrier and the pile for movement of a tractor or the like for scraping off the next section of the pile. In other embodiments combinations of permanent and moveable barriers 24 are contemplated.

In still other cases there may be one or both of leachate and clean water level sensors located within the leachate channel/pipe and the clean water channel/pipe that can be used to identify high or dangerous water levels where a computer or the like generates an alarm signal indicating high levels within the channels/pipes so that a person charged with maintaining the system can assess and deal with any blockage issues.

While various grading angles with horizontal are described above that are suitable for use with the current invention to flow rain water and other liquid (e.g., leachate) in desirable directions, it should be appreciated that the angles may be anywhere within a range between 0.5% and as much as 8%. For instance, referring again to FIG. 4, the angle with horizontal from bottom to top of each pad section (e.g., 24K) may be anywhere from 0.5% to 8% downward and from outside the pad to inside the pad section (e.g., from right to left for pad section 24K) the angle may be anywhere from 0.5% to 8% degrees. The angle from bottom to top may be different than the angle from outside to inside for each of the pad sections. For instance, the angle from bottom to top of section 24K may be a substantially constant 2% downward while the angle from outside to inside may be a substantially constant 3.5% downward, where the flow is completely in the direction of drain opening 60 of pad 24K. Angles of different pad sections may be different. For instance, referring again to FIG. 4, the angles of end pad section 241 and 24K from bottom to top may 4% while angles of other pad sections 26G and 26H may be 2.5% from bottom toward top ends of those sections.

In at least some cases it is contemplated that the bottom to top or outside to inside grade angles with horizontal of a subset or of each of the pad sections may change over the pad section dimension. Thus, for instance, pad section 24K may have a 4% angle from bottom toward top near bottom pad edge 20 and a 2% angle near pad barrier 24 at the upper edge of pad section 24K and may have a 3.5% angle from outer to inner edges and a 1.5% angle near the inner pad edge.

While ½ degree grades are enough to cause water and other liquids to flow in intended directions, it has been recognized that creating a constant ½% grade over large pad areas is very difficult and that, even when a grade of that angle is initially set, settling can cause pad sections to diverge from that original grade over time. For this reason, in at least some cases it is preferred that the grade angles with horizontal be initially set at at least two degrees and in other cases the grade angle should be at least 3.5%. To minimize settling and diverging grade angles over time, the concrete pad should be at least 4 inches in thickness and, in some cases may be 12 inches thick and re-enforced with rebar or other metal structure.

In some cases the pad sections may only slope from outer edges toward inner edges without any slope from bottom toward top limits of the section. In some embodiments, instead of having one clean water channel, the arrangement may include, effectively, three clean water channels, a first clean water channel between the two leachate channels, a second clean water channel or pipe that connects the clean water drains on one side of the leachate channels and that drains into a basin or the like that the first clean water channel drains into, and a third clean water channel or pipe that connects the clean water drains on the other side of the leachate channels and that drains into a basin or the like that the first clean water channel drains into.

In at least some cases removable grates may be provided at outflow ends of the clean water channel and the leachate channels or pipes which can be removed to unclog any degree from the outflow channel ends of those constructs.

For the purposes of the claims and this specification, the term "channel" should be considered a general term meaning any mechanical structure that forms a passageway for directing liquid, water, leachate, etc. Thus, the term "channel" may include an upwardly open elongated guiding structure, a pipe that includes end openings or any other passageway forming mechanical structure. In addition, the term "incongruity", when applied to a pad surface, should be construed as a change in angle or slope from one flat portion of the surface to an adjacent portion. Thus, for instance, where one flat portion of a surface has a 3% downward slope and an adjacent portion has a 75% upward slope (see FIG. 10), 75% sloped portion would be considered an incongruity with the 3% sloped portion. Similarly, a second portion adjacent a first flat portion may curl upward and in that case the curled portion may be considered an incongruity.

Various features and advantages of the invention are set forth in the following claims.

I claim:

1. A feed storage arrangement for use with a sheet like feed barrier, the storage arrangement comprising:

at least one elongated leachate channel having an outlet end; and at least a first feed pad section extending along at least a portion of a length dimension of the leachate channel, the first pad section including first and second lateral edges and upper and lower edges wherein the first lateral edge is located proximate the leachate channel, the second edge is spaced apart from the first edge, the upper edge is proximate the outlet end of the leachate channel, and the lower edge is opposite and spaced from the upper edge, the first pad section sloped downward starting at the second edge and toward the first edge;

a clean water channel arranged on a side of the leachate channel opposite the first pad section, wherein the water channel is configured to receive water runoff from a top surface of the feed barrier;

wherein, with feed supported on the first pad section adjacent the leachate channel, the feed barrier is positionable on top of the feed with an edge portion extending over the leachate channel to a side of the leachate channel opposite the first pad section.

2. The feed storage arrangement of claim 1 wherein the slope from the second edge toward the first edge is at least ½ degree.

3. The feed storage arrangement of claim 2 wherein the slope of the first pad section between the second and first edges is substantially uniform.

4. The feed storage arrangement of claim 1 further including a clean water drain near the first edge on a side of the leachate channel opposite the clean water channel, the drain opening downward and extending laterally past the leachate channel and into the clean water channel, the arrangement further including a solid drain cover removably positionable within the drain to close the drain and to be removed to open the drain.

5. The feed storage arrangement of claim 4 further including a sloped portion between the leachate channel and the drain that is sloped downward from the leachate channel toward the drain.

6. The feed storage arrangement of claim 5 wherein the drain is located adjacent the upper edge of the first pad section.

7. The feed storage arrangement of claim 4 wherein the first pad section slopes from the lower edge toward the upper edge.

8. The feed storage arrangement of claim 7 further including at least a second pad section having first and second lateral edges and upper and lower edges wherein the first lateral edge of the second pad section is located proximate the leachate channel, the second edge of the second pad section is spaced apart from the first edge, the upper edge of the second pad section is proximate the lower edge of the first pad section and the lower edge of the second pad section is opposite and spaced from the upper edge of the second pad section, the second pad section sloped downward starting at the second edge of the second pad section and toward the first edge of the second pad section and sloped downward starting at the lower edge of the second pad section and toward the upper edge of the second pad section, the arrangement further including a second clean water drain proximate the leachate channel and the upper edge of the second pad section that opens downward and extends laterally past the leachate channel to open into the clean water channel, the arrangement further including a second solid drain cover removably positionable within the second drain opening to close the second drain and to be removed to open the second drain.

9. The feed storage arrangement of claim 8 further including a sloped portion between the portion of the leachate channel adjacent the second pad section and the second drain that is sloped downward toward the second drain.

10. The feed storage arrangement of claim 8 further including a barrier between the first and second pad sections that inhibits liquid from passing from the second pad section to the first pad section.

11. The feed storage arrangement of claim 10 wherein the barrier forms a surface that extends upward from the second pad section adjacent the upper edge of the second pad section.

12. The feed storage arrangement of claim 11 wherein the first pad section extends from an upper edge of the surface formed by the barrier toward the upper edge of the first pad section.

13. The feed storage arrangement of claim 1 wherein the pad and leachate channel are formed out of concrete.

14. The feed storage arrangement of claim 1 wherein the leachate channel is a first leachate channel, the arrangement further including a second leachate channel and a second feed pad section, the second leachate channel extending along the clean water channel on a side of the clean water channel opposite the first leachate channel, the second pad section including first and second lateral edges and upper and lower edges wherein the first lateral edge is located along the second leachate channel, the second edge is spaced apart from the first edge and forms a pad width dimension, the upper edge is near the outlet end of the second leachate channel, and the lower edge is opposite and spaced from the upper edge and forms a pad section length dimension of the second pad section, the second pad section sloped downward starting at the second edge of the second pad section and toward the first edge of the second pad section along at least a substantial portion of the width dimension of the second pad section.

15. The feed storage arrangement of claim 14 further including a first clean water drain near the first edge of the first pad section on a side of the first leachate channel opposite the clean water channel, the first drain opening downward and extending past the first leachate channel and into the clean water channel, the arrangement further including a first solid drain cover removably positionable within the drain to close the drain and to be removed to open the drain, the arrangement further including a second clean water drain near the first edge of the second pad section on a side of the second leachate channel opposite the clean water channel, the second drain opening downward and extending past the second leachate channel and into the clean water channel, the arrangement further including a second solid drain cover removably positionable within the drain to close the drain and to be removed to open the drain.

16. The feed pad arrangement of claim 15 wherein each of the first and second pad sections angles downward from the lower edge toward the upper edge of the pad section.

17. A feed storage arrangement for use with a sheet like feed barrier, the storage arrangement comprising:

at least one elongated leachate channel having an outlet end; and at least a first feed pad section extending along at least a portion of a length dimension of the leachate channel, the first pad section including first and second lateral edges and upper and lower edges wherein the first lateral edge is located proximate the leachate channel, the second edge is spaced apart from the first edge, the upper edge is proximate the outlet end of the leachate channel, and the lower edge is opposite and spaced from the upper edge, the first pad section sloped downward starting at the second edge and toward the first edge;

wherein the feed pad includes a clean water drain that opens downward and extends laterally past the leachate channel and off the pad wherein all portions of the upper surface of the pad section angle toward the clean water drain;

wherein, with feed supported on the first pad section adjacent the leachate channel, the feed barrier is positionable on top of the feed with an edge portion extending over the leachate channel to a side of the leachate channel opposite the first pad section.

18. A feed storage arrangement for use with a sheet like feed barrier, the storage arrangement comprising:

at least one leachate channel having an opening and an outlet that leads to a leachate basin;

a clean water drain that forms an upward opening and defines a passageway that has a clean water drain outlet;

a feed pad section that forms an upper surface that is adjacent one side of the leachate channel, the upper surface formed about the upward opening of the clean water drain where the upward opening is proximate the leachate channel, the upper surface of the pad section sloped toward the upward opening so that water on all portions of the upper surface flows toward the upward opening; and an impervious cover positionable in the upward opening to close off that opening and removable from the upward opening to open the upward opening for water to pass from the pad surface through the passageway formed by the drain and out the drain outlet;

wherein, with feed supported on the pad section adjacent the leachate channel, the feed barrier is positionable on top of the feed with an edge portion extending over the leachate channel to a side of the leachate channel opposite the first pad section.

19. The feed storage arrangement of claim 18 further including a sloped portion between the leachate channel and the drain that is sloped downward from the leachate channel toward the drain.

20. The feed storage arrangement of claim 18 wherein the feed pad section is a substantially rectangular feed pad section having upper and lower edges and first and second lateral edges, the first lateral edge adjacent the leachate channel.

21. The feed storage arrangement of claim 20 wherein the first and second lateral edges are shorter than the upper and lower edges.

22. The feed storage arrangement of claim 21 wherein the clean water drain is a first drain and the feed pad section is a first feed pad section and wherein the first drain is adjacent the upper edge and the first lateral edge.

23. The feed storage arrangement of claim 22 wherein the pad section slopes downward from the second lateral edge toward the first lateral edge and slopes downward from the lower edge toward the upper edge.

24. The feed storage arrangement of claim 21 further including a first barrier that extends along substantially the entire upper edge of the first pad section wherein the first barrier inhibits liquid from passing over the first barrier from a space above the first pad section to the side of the first barrier opposite the first pad section.

25. The feed storage arrangement of claim 24 further including at least a second pad section having first and second lateral edges and upper and lower edges wherein the first lateral edge of the second pad section is located proximate the leachate channel, the second edge of the second pad section is spaced apart from the first edge, the upper edge of the second pad section is proximate the lower edge of the first pad section and the lower edge of the second pad section is opposite and spaced from the upper edge of the second pad section, the second pad section sloped downward starting at the second edge of the second pad section and toward the first edge of the second pad section and sloped downward starting at the lower edge of the second pad section and toward the upper edge of the second pad section, the arrangement further including a second clean water drain proximate the leachate channel and the upper edge of the second pad section that opens downward and extends laterally past the leachate channel to open into the clean water channel, the arrangement further including a second solid drain cover removably positionable within the second drain opening to close the second drain and to be removed to open the second drain.

26. The feed storage arrangement of claim 25 further including a sloped portion between the portion of the leachate channel adjacent the second pad section and the second drain that is sloped downward toward the second drain.

27. The feed storage arrangement of claim 25 further including a second barrier between the first and second pad sections that inhibits liquid from passing from the second pad section to the first pad section.

28. The feed storage arrangement of claim 27 wherein the second barrier forms a surface that extends upward from the second pad section adjacent the upper edge of the second pad section.

29. The feed storage arrangement of claim 18 wherein the first pad section extends from an upper edge of the surface formed by the second barrier toward the upper edge of the first pad section.

30. A feed storage arrangement for use with a sheet like feed barrier, the storage arrangement comprising:

an elongated clean water channel that extends from a first end downward along a slope to an outlet end;

a first elongated leachate channel extending a long a first side of the clean water channel from a first end downward along a slope to an outlet end;

a first feed pad located along a side of the first leachate channel opposite the clean water channel, the first feed pad forming an upper surface that includes a first plurality of substantially rectangular pad sections wherein each pad section includes an upper edge, a lower edge and first and second lateral edges, with the first lateral edges located adjacent the first leachate channel, each pad section sloped downward from its lower edge toward its upper edge and sloped downward from its second lateral edge toward its first lateral edge;

a separate incongruity between adjacent ones of the first plurality of pad sections that restricts liquid flow between pad sections on opposite sides of the incongruity;

a separate clean water drain adjacent the upper edge and first lateral edge of each one of the pad sections in the first plurality of pad sections wherein each drain includes an upward opening and forms a passageway from the upward opening past the first leachate channel and into the clean water channel;

an impervious cover receivable within and removable from the upward opening to close off the clean water drain when installed in the upward opening and open the clean water drain when removed from the upward opening;

wherein, with feed supported on any set of the pad sections adjacent the leachate channel, the feed barrier is positionable on top of the feed with an edge portion extending over the leachate channel to a side of the leachate channel opposite the first pad section.

* * * * *